United States Patent [19]

Tokuno et al.

[11] Patent Number: 4,541,335

[45] Date of Patent: Sep. 17, 1985

[54] WEB PRINTING APPARATUS WITH PRINTING PLATE CYLINDER AND WEB SPEED CONTROL

[75] Inventors: Masateru Tokuno, Nishinomiya; Tetsuya Sawada, Kyoto; Yasuharu Mori, Amagasaki, all of Japan

[73] Assignee: Rengo Co., Ltd., Osaka, Japan

[21] Appl. No.: 675,975

[22] Filed: Nov. 28, 1984

[30] Foreign Application Priority Data

Dec. 9, 1983 [JP] Japan ..... 58-233291

[51] Int. Cl.[4] ..... B41F 5/06

[52] U.S. Cl. ..... 101/181; 101/219; 101/248; 226/30

[58] Field of Search ..... 101/181, 182, 226, 219, 101/426, 248; 226/28-31

[56] References Cited

U.S. PATENT DOCUMENTS

| | | | |
|---|---|---|---|
| 2,972,297 | 2/1961 | Auerbacher | 101/181 |
| 2,978,979 | 4/1961 | Rouse | 101/219 |
| 3,329,087 | 7/1967 | Sandor et al. | 101/181 |
| 3,510,036 | 5/1970 | Lewis, Jr. et al. | 226/30 X |
| 3,559,568 | 2/1971 | Stanley | 101/219 |
| 3,648,911 | 3/1972 | Pekrul | 226/30 |
| 3,677,177 | 7/1972 | Smith, Jr. | 101/228 |
| 3,808,971 | 5/1974 | Staamann | 101/181 |
| 3,841,216 | 10/1974 | Huffman | 101/181 |
| 3,869,983 | 3/1975 | Garber | 101/181 |
| 4,177,730 | 12/1979 | Schriber | 101/248 |
| 4,207,815 | 6/1980 | Watanabe | 101/181 X |
| 4,437,402 | 3/1984 | Fischer | 101/181 |
| 4,473,009 | 9/1984 | Morgan | 101/181 X |

FOREIGN PATENT DOCUMENTS

| | | | |
|---|---|---|---|
| 2706565 | 8/1977 | Fed. Rep. of Germany | 101/177 |

*Primary Examiner*—E. H. Eickholt

*Attorney, Agent, or Firm*—Wenderoth, Lind & Ponack

[57] ABSTRACT

An improved printing apparatus for printing a running web is proposed which includes printing units each having a plate cylinder adapted to carry two plates, a pair of impression cylinders mounted in diametrically opposite directions, and adjust rolls for guiding the web so that the length of web existing between two contact points will be three or more odd number of times as long as the printing length. The plate cylinder or the web is controlled so that during the printing, the peripheral speed of the plate cylinder will be equal to the web speed, and from the print end to the next print start, the plate cylinder will move for a distance equal to the gap between the two plates.

2 Claims, 9 Drawing Figures

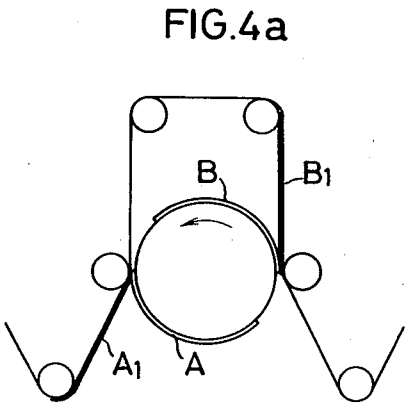
FIG.4a
FIG.4b
FIG.4c
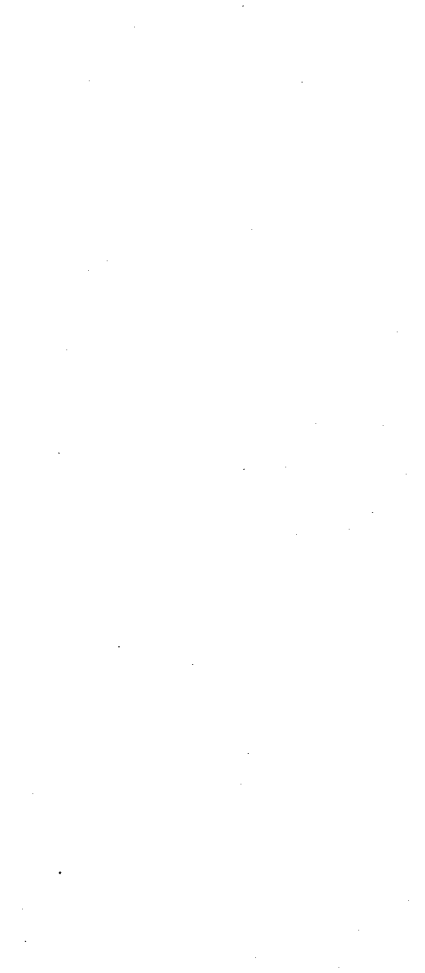
FIG.4d
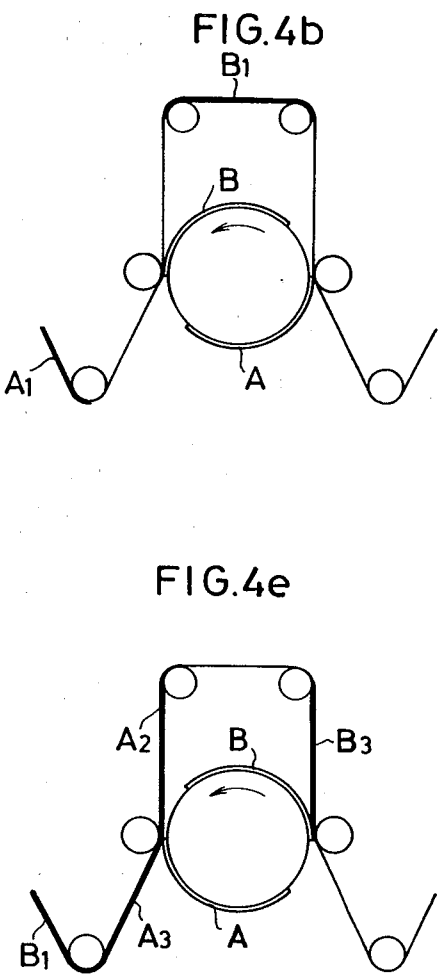
FIG.4e
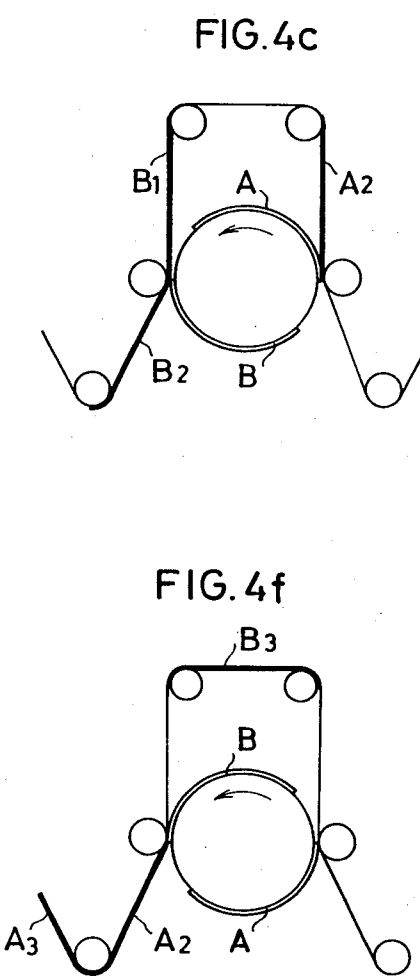
FIG.4f

WEB PRINTING APPARATUS WITH PRINTING PLATE CYLINDER AND WEB SPEED CONTROL

The present invention relates to improvements in a printing apparatus for printing a running web.

FIG. 1 shows a conventional color printing apparatus in which as the web 4 to be printed passes between an impression cylinder 1 and plate cylinders 2, it is printed by plates 3 mounted on the plate cylinders. The impression cylinder and the plate cylinders are driven from a single motor through a geared transmission for synchronized printing. Since the diameter of the plate cylinders is determined by the printing length which is the length of the plate, each time the printing length changes, new plate cylinders having a circumference corresponding to the new printing length become necessary. This increases the printing cost. Further, each time the printing length changes, heavy plate cylinders have to be replaced with new ones. New plate cylinders with new plates mounted thereon have to be mounted on the impression cylinder with a suitable contact pressure. This is very troublesome work. Further, fine adjustments of the transmission were necessary for phase tuning between the plate cylinders for accurate register. Another disadvantage is that a lot of plate cylinders have to be maintained.

An object of the present invention is to provide an improved printing apparatus which obviates the necessity of preparing different plate cylinders for different printing lengths.

In accordance with the present invention, there is provided a printing apparatus for printing a running web, comprising at least one printing unit having a plate cylinder having a circumference (B) longer than double the printing length (L) and adapted to carry two plates, a pair of impression cylinders mounted on the plate cylinder to press the web against the plates on the plate cylinder in diametrically opposite positions, and means for guiding the web so that the length of the web existing between one contact point (between one of the impression cylinders and the plate cylinder) and the other contact point (between the other of the impression cylinders and the plate cylinder) will be three or more odd number of times as long as the printing length, first drive means for driving the web, second drive means for driving the plate cylinders, and control means for controlling the first or second drive means so that during the period from the print start to the print end, the former will be equal to the latter and, from the print end to the next print start, the plate cylinder will move for a distance equal to $(B/2-L)$ while the web moves for a distance equal to the printing length (L).

Other objects and features of the present invention will become apparent from the following description taken with reference to the accompanying drawings, in which.

FIGS. 4*a*–4*f* are views sequentially showing how the web is printed continuously.

Figure 2:
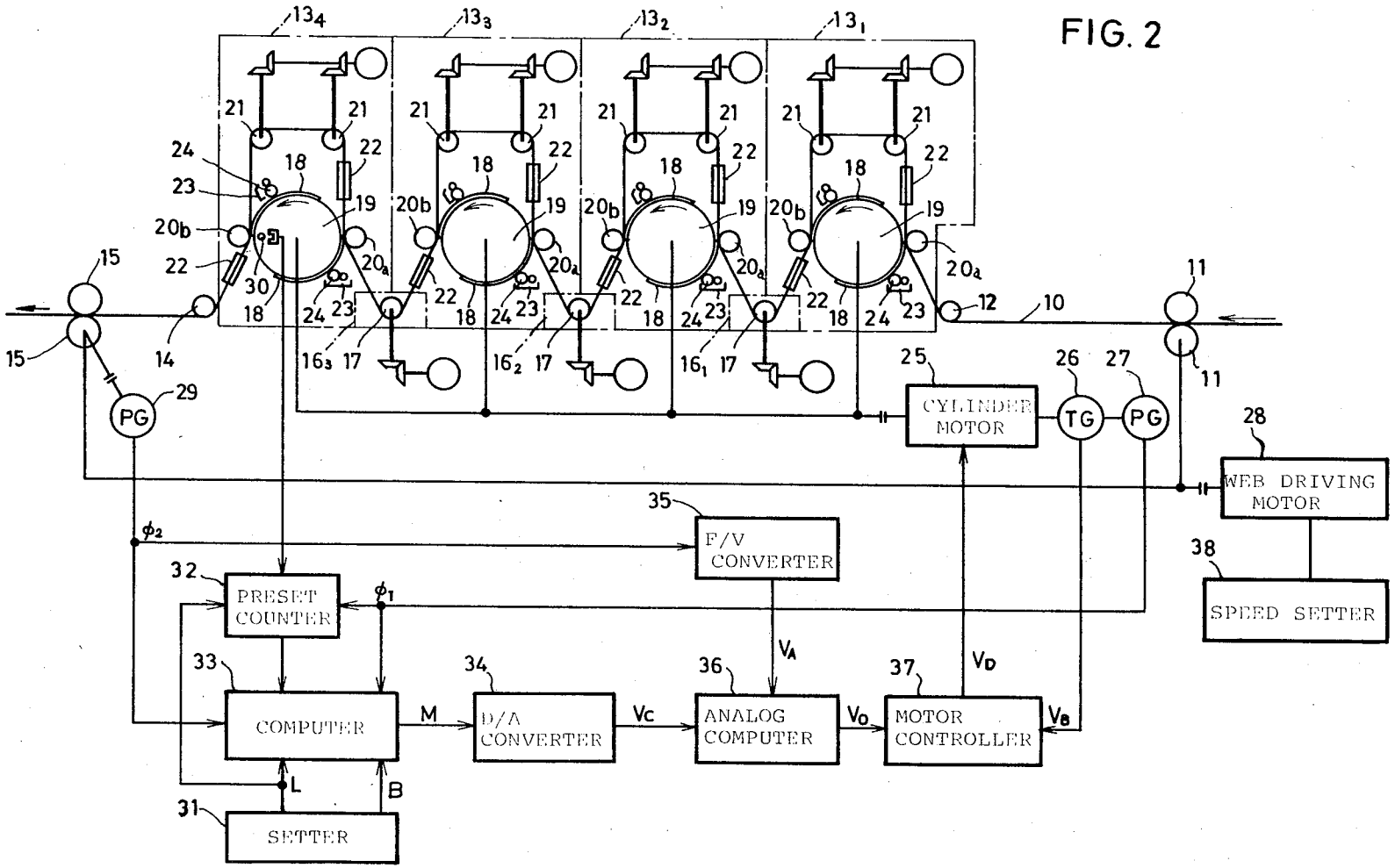
FIG. 2 is a block diagram showing a preferred embodiment.

Referring to FIG. 2, a web 10 passes between a pair of feed rolls 11, around a first paper roll 12, through printing units $\mathbf{13}_1$, $\mathbf{13}_2$, $\mathbf{13}_3$ and $\mathbf{13}_4$, around a second paper roll 14 and between a pair of pull rolls 15, and is fed to the next station.

Between the adjacent printing units there are web length adjusting units $\mathbf{16}_1$, $\mathbf{16}_2$ and $\mathbf{16}_3$ for adjusting the length of web existing between the adjacent printing units to the printing length multiplied by an integer. Each web length adjusting unit comprises a vertically movable adjuster roll 17. By adjusting the height or vertical position of the adjuster roll, the length of web existing between the adjacent printing units is adjusted to the printing length multiplied by an integer.

Each printing unit $\mathbf{13}_1$–$\mathbf{13}_4$ comprises a plate cylinder 19 having a circumference longer than double the printing length and adapted to carry two plates 18 in diametrically opposite positions, a pair of impression cylinders 20*a* and 20*b* adapted to press the web 10 against the plates 18 on the plate cylinder 19, a pair of adjuster rolls 21, driers 22 disposed downstream of the impression cylinders 20*a* and 20*b* for drying the ink applied by the plates 18 to the surface of the web, and ink rolls 24 for applying ink in ink reservoirs 23 to the plates 18 on the plate cylinder 19. After having been printed by the plates 18, the web 10 is dried by the driers 22 and discharged from the printing station. The adjuster rolls 21 are in such a position that the length of web 10 existing between one contact point (between one of the impression cylinders and the plate cylinder) and the other contact point (between the other of the impression cylinders and the plate cylinder) will be three or more odd number of times as long as the printing length. (Actually, the plate cylinder and the impression cylinders are not in direct contact but through the web and the plate.)

The plate cylinders 19 in the printing units $\mathbf{13}_1$–$\mathbf{13}_4$ are coupled to a motor 25 through a transmission (not shown) having gears, sprockets and/or chains for synchronized driving. A tachometer generator 26 and a first pulse generator 27 for detecting the amount of revolutions of the plate cylinder 19 are connected to the motor 25 for the plate cylinders (hereinafter referred to as the cylinder motor).

The feed rolls 11 and the pull rolls 15 are connected to a web driving motor 28 through a transmission (not shown) having gears, sprockets and/or chains so that they will turn at the same peripheral speed. A second pulse generator 29 is connected to one of these rolls (to the pull roll 15 in the embodiment of FIG. 2) to detect the length for which the web 10 has run. A print start detector 30 is provided adjacent to the plate cylinder 19 of one of the printing units $\mathbf{13}_1$–$\mathbf{13}_4$ in order to detect the start of printing.

The web length adjusting unit $\mathbf{16}_n$(n is 1, 2 and 3) serves to adjust the length existing between the contact point (between the plate cylinder 19 of the printing unit $\mathbf{13}_n$ and its impression cylinder 20*b*) and the contact point (between the plate cylinder 19 of the printing unit $\mathbf{13}_{n+1}$ and its impression cylinder 20*a*) to the printing length multiplied by an integer.

On a setter 31, the circumference B of the plate cylinder 19 (with the thickness of a plate taken into consideration) and the printing length L (that is usually the length of the plate 18) can be set. Since the value B is fixed once the size of the plate cylinder 19 has been determined, only the printing length L may be settable.

In response to the print start signal from the print start detector 30, a preset counter 32 reads the printing length L and simultaneously starts to count a first pulse signal $\phi_1$ from the first pulse generator 27. When its count becomes equal to the printing length L, the preset counter will give a print end signal to show that the printing with the plate 18 is complete.

A computer 33 reads a compensation value $2L-B/2$ in response to the print end signal, adds the first pulse signal $\phi_1$ from the first pulse generator 27 and subtracts a second pulse signal $\phi_2$ from the second pulse generator 29. Namely, the computer 33 performs computation $2L-B/2-\phi_2+\phi_1$. The result M of computation is converted by a D/A converter 34 to an analog error voltage $V_c$.

An F/V converter 35 receives the pulse signal $\phi_2$ from the second pulse generator 29 and outputs a line speed voltage $V_A$ proportional to the frequency of the pulse signal $\phi_2$. An analog computer 36 subtracts the error voltage $V_C$ from the line speed voltage $V_A$ to obtain a speed command voltage $V_o(=V_A-V_C)$. A motor controller 37 compares the speed command voltage $V_O$ with a speed voltage $V_B$ from the tachometer generator 26 and gives a motor voltage $V_D$ to the motor 25 for the plate cylinders so that it will be driven at just the speed command voltage $V_O$.

Next, operation will be described below in detail.

Firstly, the circumference B of the plate cylinder 19 and the printing length L are set in the setter 31. The adjuster rolls 17 in the web length adjusting units $16_1$–$16_3$ are moved to adjust the length of the web existing between the adjacent ones of the printing units $13_1$–$13_4$ to the printing length multiplied by an integer. Two plates 18 are then set on the plate cylinder 19 of each printing unit in diametrically opposite directions, and ink of a required color is filled in the ink reservoirs 23 in each printing unit.

The speed for the web driving motor 28 is set on a speed setter 38. A machine switch is turned on to start printing. The motor 28 will be driven at the speed preset on the speed setter 38, so that the web 10 will run at the preset constant speed. The F/V converter 35 gives a line speed voltage $V_A$ proportional to the web speed.

On the other hand, the cylinder motor 25 is controlled by the computer 33, etc. so that the peripheral speed of the plate cylinders 19 (which is, strictly speaking, the peripheral speed of the plate 18, but hereinafter referred to as the peripheral speed of the plate cylinder for simplicity) will be as shown on the graph of FIG. 3. Namely, it will be controlled to be equal to the web speed during the period from the print start point $T_{11}$ to the print end point $T_{12}$. During the period, the plate cylinder turns for a distance equal to the printing length L, that is, the length of the plate 18. During the period from the print end point $T_{12}$ to the next print start point $T_{21}$, the web 10 runs for a distance equal to the printing length L whereas each plate cylinder 19 is decelerated and accelerated until its peripheral speed again becomes equal to the web speed at the next print start point $T_{21}$ at latest, so that it will turn for a distance equal to $(B/2-L)$ which is the peripheral gap between the two plates 18.

The arrangement is such that the web is printed for the printing length L while it passes between one of the two plates 18 and one impression cylinder 20*a* of each printing unit, and runs unprinted for a distance equal to the printing length L, and is printed for the printing length L while it passes between the other of the two plates 18 and the impression cylinder 20*a*. Thus, on the web passed under the first impression cylinder 20*a*, the printed portions and the non-printed portions will appear alternately. However, the portions that were not printed at the side of the impression cylinder 20*a* are printed without fail at the side of the other impression cylinder 20*b*, since the length of the web existing between one contact point (between the plate cylinder 19 and one impression cylinder 20*a*) and the other contact point (between the plate cylinder 19 and the other impression cylinder 20*b*) is three or more odd number of times as long as the printing length L. This results that the web is printed continuously without any gaps, as will be best understood from FIG. 4, in which A and B designate two identical plates and $A_1$, $A_2$, $A_3$ and $B_1$, $B_2$, $B_3$ are the portions of web printed with the plate A and the plate B, respectively. Some unprinted portions appear at the beginning, but some time after, the web is printed continuously without leaving any portions unprinted.

Also, since the length of the web existing between the adjacent printing units is the printing length L multiplied by an integer, the web is printed with desired colors overlapped with accurate register. The above-said control assures that the web has been multicolor printed continuously when it leaves the pull rolls 15.

It will be described in more detail how the peripheral speed of the plate cylinder 19 is controlled.

When the printing with the plate 18 ends, a print end signal is given to the computer 33 by the preset counter 32. In response to it, the computer 33 will read the printing length L and the circumference B of each plate cylinder 19 and starts the computation $(2L-B/2-\phi_2+\phi_1)$. At the start, the result M of computation should be sufficiently large. Thus, the speed command voltage $V_O=V_A-V_C<O$. Because the cylinder motor 25 is controlled by the voltage $V_O$, the plate cylinders 19 will be decelerated. Accordingly, the first pulse signal $\phi_1$ decreases whereas the second pulse signal $\phi_2$ is constant because the web 10 is fed by the motor 28 at a predetermined constant speed. Therefore, the result M of computation and thus the error voltage $V_C$ gradually decreases. Accordingly, the speed command voltage $V_O$ will become from negative to positive, so that the cylinder motor 25 will be accelerated until the peripheral speed of the plate cylinder becomes again equal to the web speed at the next print start point (where the print start detector 30 operates) at latest. While such an equi-speed state is maintained, the result M of computation and thus the error voltage $V_C$ will remain zero.

If the peripheral speed of the plate cylinder 19 becomes higher than the web speed, the first pulse signal $\phi_1$ will increase, so that the result M of computation and thus the error voltage $V_C$ will become larger than zero and the speed command voltage $V_O(=V_A-V_C)$ will decrease by the error voltage $V_C$. As a result, the cylinder motor 25 will be decelerated until the peripheral speed of the plate cylinder becomes again equal to the web speed. Thus, the motor 25 is controlled so that M and $V_C$ will be kept at zero.

If the peripheral speed of the plate cylinder 19 becomes lower than the web speed, the first pulse signal $\phi_1$ will decrease, so that the result M of computation and thus the error voltage $V_C$ will become smaller than zero and the speed command signal $V_O$ will increase by the error voltage $V_C$. Therefore, the cylinder motor 25 will be accelerated until the cylinder speed becomes again equal to the web speed. The motor 25 is controlled so that M and $V_C$ will be kept at zero.

Figure 1:
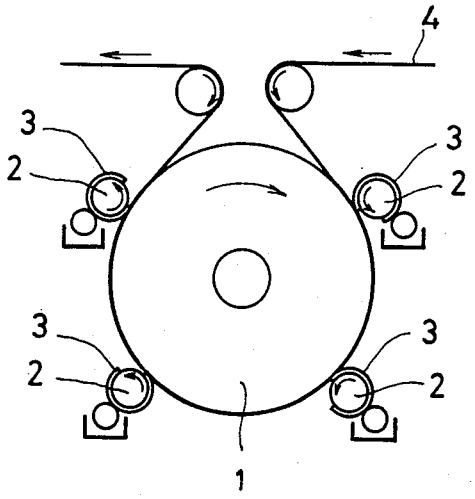
FIG. 1 is a schematic view of a prior art color printing machine.
Figure 3:
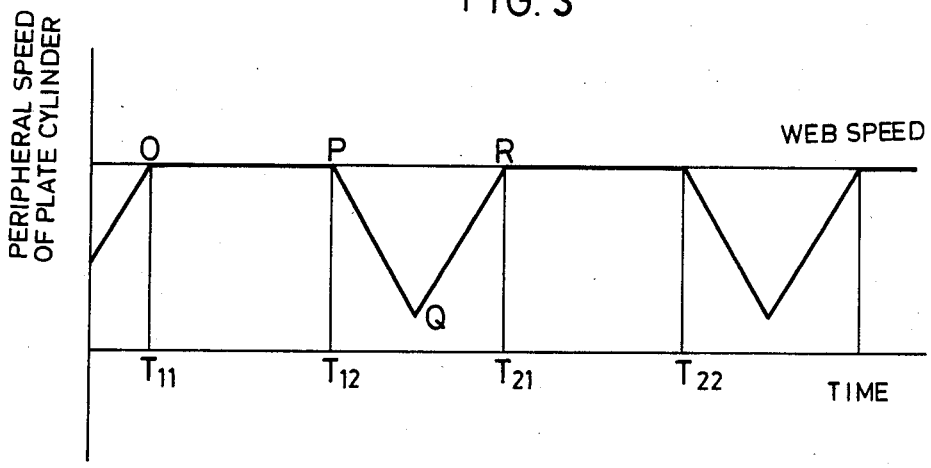
FIG. 3 is a graph showing how the speed of the plate cylinder changes.

Thus, as shown in FIG. 3, during the period from the print start $T_{11}$ to the print end $T_{12}$, the web 10 moves for a distance equal to the printing length L whereas the plate cylinders 19 are controlled on the basis of the line speed voltage $V_A$ to be driven at the same speed as the web speed. The peripheral distance covered by the plate cylinder during the period, too, will be equal to the printing length L, which corresponds to the area of the rectangle $T_{11}T_{12}PO$. During the period from the print end $T_{12}$ to the next print start $T_{21}$, the web moves for a distance equal to the printing length whereas the plate cylinders 19 are controlled to be firstly decelerated as shown at P-Q and then accelerated as shown at Q-R so that they will move for a peripheral distance equal to (B/2−L) which is the length of the gap between the two plates 18 and corresponds to the area of a pentagon $T_{12}T_{21}RQP$.

In other words, during the period from the print start $T_{11}$ to the next print start $T_{21}$, the web 10 moves for a distance equal to 2L (corresponds to the area of a square $T_{11}T_{21}RO$) whereas the plate cylinders 19 are controlled to turn for a peripheral length equal to B/2 (corresponds to the area of a hexagon $T_{11}T_{21}RQPO$)

FIG. 3 shows a mere example of change of the peripheral speed of the plate cylinders 19. How it changes depends on the printing length L (that is, the length of the plates) relative to the circumference B of the plate cylinder 19. It may be controlled otherwise so long as the distance covered by the plate cylinders during the period from the print end $T_{12}$ to the next print start $T_{21}$ will be exactly equal to (B/2−L). For example, the plate cylinders may be maintained at the web speed for some time even after the print end $T_{12}$. Or, they may be kept at a low speed or kept stopped for some time after deceleration. Or, they may attain again the web speed some time before the next print start $T_{21}$.

Further, if $B/2-L<L$ (namely, $2L-B/2<O$), the plate cylinders 19 are firstly accelerated and then decelerated after the print end until their speed becomes again equal to the web speed, so that the distance covered by the plate cylinders 19 during the period from the print end $T_{12}$ to the next print start $T_{21}$ will be (B/2−L).

In the embodiment of FIG. 2, the peripheral speed of the plate cylinders 19 are controlled with the web speed kept constant. However, the web speed may be controlled with the speed of the plate cylinders kept constant. Such a control will be described below.

This manner of control differs from the abovementioned embodiment in that the F/V converter 35 receives the pulse signal $\phi_1$ proportional to the number of revolutions of the plate cylinders, not the pulse signal $\phi_2$ proportional to the distance covered by the web, and gives to the analog computer 36 the line speed voltage corresponding to the frequency of the pulse signal $\phi_1$. Also, the tachometer generator 26 and the pulse generater 27 are connected not to the cylinder motor 25 but to the web driving motor 28. In this embodiment, the web driving motor 28 is controlled with the speed command signal $V_O$ in the same manner as in the first embodiment whereas the cylinder motor 25 is driven at a constant speed.

Although in the preferred embodiment the print start detector 30 and the preset counter 32 are used, they may be replaced with a print end detector which detects the end of printing with the plate 18.

The abovesaid printing length may not be a single printing length in a continuous printing with no blank between the adjacent printed portions, but include any allowance for subsequent cutting, glueing or other processing as well as the actually printed portion.

Although in the preferred embodiment a plurality of printing units are used for multicolor printing, a single printing unit will do for monochrome printing. The apparatus according to the present invention is applicable to monochrome printing, too.

What are claimed are:

1. A printing apparatus for a running web, comprising:

at least one printing unit having a plate cylinder having a circumference (B) longer than double the printing length (L) and adapted to carry two plates, a pair of impression cylinders mounted on said plate cylinder to press the web against said plates on said plate cylinder in diametrically opposite positions, and means for guiding the web so that the length of the web existing between one contact point (between one of said impression cylinders and said plate cylinder) and the other contact point (between the other of said impression cylinders and said plate cylinder) will be three or more odd number of times as long as the printing length, first drive means for driving the web, second drive means for driving said plate cylinders, and control means for controlling said first or second drive means so that during the period from the print start to the print end, the web speed will be equal to the peripheral speed of the plate cylinder and, from the print end to the next print start, said plate cylinder will move for a distance equal to (B/2−L) while the web moves for a distance equal to the printing length (L).

2. A printing apparatus as claimed in claim 1, wherein a web length adjusting unit is provided between the adjacent ones of said printing units to adjust the length of the web existing between the adjacent printing units to the printing length multiplied by an integer.

* * * * *